US006026574A

United States Patent [19]

Ghavami et al.

[11] Patent Number: 6,026,574

[45] Date of Patent: Feb. 22, 2000

[54] CIGAR PLUG CUTTING APPARATUS

[76] Inventors: Bert Ghavami, 30 Snyder Rd., Englewood Cliffs, N.J. 07632; John J. Haydu, 317 Hazel Ave., Garwood, N.J. 07027

[21] Appl. No.: 09/049,258

[22] Filed: Mar. 27, 1998

Related U.S. Application Data

[60] Provisional application No. 60/042,863, Mar. 28, 1997.

[51] Int. Cl.[7] ..... A24F 13/24

[52] U.S. Cl. ..... 30/109; 30/111; 30/162; 131/252; 131/255

[58] Field of Search ..... 30/109, 113, 111, 30/113.1, 162; 131/248, 252, 253, 254, 255, 350; D27/195

[56] References Cited

U.S. PATENT DOCUMENTS

| | | | |
|---|---|---|---|
| D. 82,134 | 9/1930 | Caiazzo . | |
| 87,062 | 2/1869 | Paine . | |
| 127,649 | 6/1872 | Sheehy . | |
| D. 245,347 | 8/1977 | Casey . | |
| 257,925 | 5/1882 | Faas . | |
| 260,117 | 6/1882 | Oakman . | |
| D. 268,137 | 3/1983 | Cervantes . | |
| D. 272,951 | 3/1984 | Cervantes . | |
| 282,764 | 8/1883 | Peavey . | |
| 297,396 | 4/1884 | Hickisson et al. . | |
| 297,956 | 4/1884 | Ungerer | 131/255 |
| 319,456 | 6/1885 | Collard . | |
| 340,212 | 4/1886 | Heath et al. . | |
| 367,800 | 8/1887 | Fairchild . | |
| 376,511 | 1/1888 | Carter | 131/255 |
| 485,234 | 11/1892 | Smith | 30/109 X |
| 662,751 | 11/1900 | Bartel . | |
| 799,364 | 9/1905 | White . | |
| 965,991 | 8/1910 | Craig . | |
| 1,086,463 | 2/1914 | Robbins . | |
| 1,189,962 | 7/1916 | Joller . | |
| 1,284,566 | 11/1918 | Benson | 131/255 |
| 1,734,620 | 11/1929 | Giacopini | 131/255 |
| 1,908,890 | 3/1932 | Burns . | |
| 1,910,342 | 5/1933 | Kivikink | 131/255 |
| 2,126,640 | 8/1938 | Johnson . | |
| 2,134,826 | 11/1938 | Hoffman . | |
| 2,338,592 | 1/1944 | Lorenzen . | |
| 2,664,091 | 12/1953 | Thostenson . | |
| 2,843,135 | 7/1958 | Lisiewski | 131/255 |
| 4,068,375 | 1/1978 | Rathbun et al. | 30/162 X |
| 4,139,939 | 2/1979 | Crooks | 30/162 X |
| 4,733,674 | 3/1988 | Sielck et al. | 131/255 |
| 4,748,743 | 6/1988 | Anderson et al. . | |
| 4,769,912 | 9/1988 | Davos | 30/162 |
| 5,012,581 | 5/1991 | Fletcher et al. . | |
| 5,230,152 | 7/1993 | Kennedy | 30/162 |
| 5,511,261 | 4/1996 | Collins . | |
| 5,535,763 | 7/1996 | Conte | 131/255 |

*Primary Examiner*—M. Rachuba
*Attorney, Agent, or Firm*—Weingram & Associates, P.C.

[57] ABSTRACT

The cigar plug cutter apparatus of the present invention overcomes the disadvantages of the known devices to provide a more accurate and safe cut of the cigar tip. The apparatus of the present invention for cutting and removing a plug-like portion from the tip of a cigar consisting of: a housing for encasing a retractable cutting tool mechanism, the cutting tool mechanism including a carriage slideable within the housing which is capable of being manipulated from an exterior of the housing; at least one hollow cylindrical tube connected at a first end to the slideable carriage and extending to a second end which is extendable to project out of the housing for use to cut the cigar, and automatically retractable into the housing when the cutter is not in use, the second free end of the tube having an edge capable of cutting into the tip of a cigar; and at least one spring which coacts at its end with the slideable carriage and at its other end with an inner end portion of the housing such that the spring is capable of biasing the slideable carriage within the housing in a set location after each use. In a preferred embodiment, this set location has the carriage assembly centered in the housing.

11 Claims, 7 Drawing Sheets

CIGAR PLUG CUTTING APPARATUS

RELATED APPLICATION

This application is related to U.S. application Ser. No. 60/042,863, filed Mar. 28, 1997.

BACKGROUND OF THE INVENTION

1. Field of the Invention

This invention generally relates to a cigar plug cutting apparatus and more particularly, to a cigar plug cutting apparatus having at least one retractable cylindrical blade.

2. Description of the Related Art

Some cigars, particularly the least expensive varieties, are produced with a pre-formed hole extending from the tip and partially inward towards the other end of the cigar to allow for smoke to be drawn through the hole by the cigar smoker. This type of pre-formed hole is usually the result of a cylindrical or elongated object disposed such that the wrappings or filler of the cigar are turned around the elongated member during production of the cigar. Upon completion of the cigar wrapping after the shade or cover layer of leaf is provided to the cigar, the elongated member or cylindrical object is removed providing a hole through which smoke can be drawn. In effect, the pre-formed holes are not cut into the filler, but rather displace the filler from the cigar tip, which produces a less effective and reduced draw for the user of the cigar.

Many higher quality or "premium" cigars are produced without a pre-formed hole in the tip. The tips of these premium cigars have to be cut away or cut into, in one way or another to expose the interior and inner wrappings of the tobacco and allow for smoke to be drawn through the cigar.

Previous attempts at cutting the tip of a cigar include making a straight cut perpendicular to the length of the cigar with a guillotine type cutter. Another type of cut has been to remove by cutting a wedge or V-shaped portion from the cigar tip to achieve the same result as the straight cut. These types of cuts may be acceptable to the less discerning cigar smokers.

However, the type of cut most preferred by cigar aficionados is the plug cut. This type of cut removes a cylindrical portion from the cigar end. Upon removal of the blade, there remains a plug-like hole having a certain depth, but at least deep enough to expose the inner wrappings of the cigar. This hole is different for its dimensions to improve the "draw" of the premium cigar. In addition, with this type of cut, only a necessary amount of outer wrapping of tobacco is removed.

One such type of plug cutter is commonly known as "the bullet", so named because it is shaped and contained like a bullet when not in use. That is, the bullet generally consists of two main portions. The first portion consists of a cylinder having a first end and a second end. The first end is solid and is shaped like the striking end of a bullet. The second end is hollow and has a sharpened edge. This edge is used as a cylindrical blade for cutting the tip of the cigar. It is hollow so that the cutter can cut into the tip of the cigar to the necessary depth and so that the portion of the cigar that is removed after cutting can be retained in the bullet and disposed. The second portion of bullet functions as a cap which fits in a snapping action over the second end of the first portion to protect the blade edge and the user.

This type of plug cutter is not retractable and although it has a cap, the blade is still vulnerable to damage and dangerous to the user, especially if the cap is lost. In addition, this type of cutter only has a single cylindrical tube which is, therefore, limited to providing plug cuts of a single diameter. Thus, if the diameter of the cutting cylinder is larger than the diameter of the cigar to be cut, the cutter cannot be used effectively or at all. Thus, there is a need for a single cigar cutter which is capable of cutting and removing plug-like portions from cigars of varying diameters. In addition, there is a need for a cigar cutter constructed so that the sharp and dangerous blade is exposed only when necessary, i.e. when the cutter is in use, and thereafter, is retractable to avoid damage to the cutting edge and injury to the user.

It would also be advantageous to have a cigar plug cutter which upon extraction of the plug cut from the cigar tip, prevents the cigar plug from entering the cutting mechanism so that the plug can be disposed immediately to prevent the mechanism from fouling with the cigar plug.

It would also be advantageous to have a cigar plug cutter having blades with cutting edges with multiple diameters to provide for different sized cigars.

It would also be desirable to have a cigar plug cutter which automatically biases or retains the cutting edge within a housing for the cutter such that the cutting edge is only deployed intentionally.

U.S. Pat. No. 87,062 to Paine discloses a pegging awl consisting of a hollow metallic cylinder from which a circular bar protrudes at one end thereof and which is spring biased to force an awl from an opposite end of the metallic cylinder.

U.S. Pat. No. 127,649 to Sheehy discloses an improvement in cigar-holders and perforators consisting of a center piece or stand which supports a cone-shaped holder in which a cigar is inserted for a knife blade to be pushed downward into the cone-shaped holder and perforate the cigar.

U.S. Pat. No. 965,991 to Craig discloses a biscuit cutter consisting of a housing in which a sharp implement is disposed and biased for projection from the bottom of the housing to cut a biscuit.

U.S. Pat. No. 1,189,962 to Joller discloses a cigar holder consisting of an open ended tubular casing having at an end opposite to the opening a needle extending from the casing to be pushed to an interior of the casing against a spring to perforate an end of a cigar disposed in the casing.

U.S. Pat. No. 2,126,640 to Johnson discloses a record punch consisting of a tube with a lower extremity bifurcated to provide cutting edges. A plunger is disposed in the tube and is depressed therein against a spring to extend a slight distance beyond a lower extremity of the tube to guard the cutting edges.

U.S. Pat. No. 2,134,826 to Hoffman discloses a pocket type cigarette extinguisher consisting of a casing in which a horizontal tube is formed to receive a cigarette. An operating stem for a cutting blade extends from the casing and is movable against a spring to penetrate the cigarette and sweep down through it in a cutting action.

U.S. Pat. No. 2,338,592 to Lorenzen discloses a can punch consisting of a cylindrical casing having a bore extending therethrough and a lower lip arranged to engage the side of a can. A plunger extends into the casing to actuate a spring biased cutting element to cut the can.

U.S. Pat. No. 2,664,091 to Thostenson discloses a combination cigarette case and cutter consisting of a container having an opening in the top in which a cigarette is inserted and against which a cutter blade is manually pivoted to cut the end of the cigarette. The cut end is retained in the cigarette case.

U.S. Pat. No. 4,748,743 to Anderson et al discloses a utility knife with an improved blade locking feature consisting of a blade holder having a slot therein from which a thumb grip member extends to deploy the cutting blade from the casing.

U.S. Pat. No. 5,012,581 to Fletcher et al discloses a universal utility knife consisting of a pair of halves to form a casing for the knife in which is disposed a cutting blade having a thumb piece extending from a side of the casing to control movement of the blade into and out of the casing.

U.S. Pat. No. 5,511,261 to Collins discloses a utility tool consisting of an elongated body member having a substantially rectangular box shape in which three parallel channels are arranged therein. A plurality of longitudinally extending slots at the housing correspond to channels for receiving a respective screw shaft to secure a respective tool member in the channel to a particular position with respect to the casing.

U.S. Pat. No. Des. 82,134 to Caiazzo, U.S. Pat. No. Des. 245,347 to Casey, U.S. Pat. No. Des. 268,137 to Cervantes, and U.S. Pat. No. Des. 272,951 to Cervantes are directed to designs for cigar and cigarette cutting devices.

Other devices to cut cigars are disclosed in U.S. Pat. No. 257,925 to Fass, U.S. Pat. No. 260,117 to Oakman, Jr., U.S. Pat. No. 282,764 to Peavey, U.S. Pat. No. 297,396 to Hickisson et al, U.S. Pat. No. 319,456 to Collard, U.S. Pat. No. 340,212 to Heath et al, 367,800 to Fairchild, U.S. Pat. No. 662,751 to Bartel, U.S. Pat. No. 799,364 to White, 1,086,463 to Robbins, and U.S. Pat. No. 1,908,890 to Burns.

OBJECT AND SUMMARY OF THE INVENTION

The cigar plug cutter apparatus of the present invention overcomes the disadvantages of the known devices to provide a more accurate and safe cut of the cigar tip. The apparatus of the present invention for cutting and removing a plug-like portion from the tip of a cigar consists of: a housing for encasing a retractable cutting tool mechanism, the cutting tool mechanism including a carriage slideable within the housing which is capable of being manipulated from an exterior of the housing; at least one hollow cylindrical tube connected at a first end to the slideable carriage and extending to a second end which is extendable to project out of the housing for use to cut the cigar, and automatically retractable into the housing when the cutter is not in use, the second free end of the tube having an edge capable of cutting into the tip of a cigar; and at least one spring which coacts at its end with the slideable carriage and at its other end with an inner end portion of the housing such that the spring is capable of biasing the slideable carriage within the housing in a set location after each use. In a preferred embodiment, this set location has the carriage assembly centered in the housing.

In another aspect of the present invention, the slideable carriage may be temporarily lockable in a selected operational position when the cutter is being used, such that the cutter may be operated without the user having to maintain pressure on the carriage to counteract the center-biasing forces of the spring while the cutter is in use.

In use, when the slideable carriage is activated by the user, the carriage is slid to one side of the housing or the other such that the sharp edge of the tube is exposed for cutting away a plug-like section of the cigar. Once the cutting and removing of the plug is achieved, the slideable carriage is released by the user and is retracted in the housing via the biasing of the spring. As described above, when the carriage includes a locking feature, the user slides the carriage to one side of the housing to expose the cutting tube and thereupon the carriage will lock in the selected operational position. Once the cigar tip has been cut, the user then unlocks the carriage by sliding it slightly toward the center of the housing until it is unlocked. After unlocking the carriage, it is biased towards the middle of the housing via the spring.

In a preferred embodiment, there is provided a second tube with a diameter different from that of the first tube. Having two tubes of varying diameters accommodates differences in the diameters of certain cigars. In this particular embodiment, there is also provided a second spring which is attached like the first spring, however in the opposite position. In this embodiment, when the slideable carriage is activated in either direction to expose either cutting tube, once the cigar has been cut and the plug removed from the cigar, the slideable carriage is biased back to its set position and the sharp portion of the tube is retracted into the housing. This embodiment may also include a locking portion to allow for locking of the carriage in either direction that the cutting tube is deployed.

In a most preferred embodiment, the cutting tool mechanism includes an ejector pin for ejecting the plug from the cutting tube. The pin is fixably attached within the housing and within at least the first tube such that it does not substantially interfere with the slideable carriage or other portions of the cutting tool mechanism.

In yet another preferred embodiment, the housing has a cut-out portion in one of its sides, defining a carriage receiving space to allow for user contact with the slideable carriage. In this embodiment, the slideable carriage has a knob or protrusion atop one surface which is exposed through the cut-out portion of the housing. This knob is provided to aid the manipulation of the slideable carriage from the non-use (neutral) or centered position, to the use (cutting) position.

In still another preferred embodiment, the first cutting tube has a diameter of 6 mm and the second tube has a diameter of 8 mm to accommodate cigars having different ring sizes.

It is therefore an object of the present invention to provide a cigar plug cutter apparatus having at least one cutting edge which can be deployed from a housing for the invention to a select distance from the housing for cutting of cigars.

It is another object of the present invention to provide an apparatus having a pair of opposed cutting edges constructed and arranged to remove different sized plug-portions from cigar ends.

It is another object of the present invention to provide a cigar plug cutter with a carriage assembly slideable within the housing for the apparatus to deploy the cutting edge as needed.

It is another object of the present invention to provide a cigar plug cutter which, when not used, automatically maintains the cutting edges in the closed or neutral position to reduce the possibility of the cutting edge being dulled or causing damage to the user.

It is another object of the present invention to provide a cutting apparatus which automatically returns the carriage assembly to the neutral position such that the blade is withdrawn into the housing.

It is another object of the present invention to provide a cutting apparatus which provides a locking feature for the carriage assembly such that the assembly can be locked in a selected position for the cutting blade to be used repetitively.

It is another object of the present invention to provide a cutting apparatus with a locking feature which prevents unintended movement of the cutting edge.

It is another object of the present invention that provides a cutting edge having a cylindrical shape for removing a uniform plug-like portion from an end of the cigar.

It is another object of the present invention to provide a cutting apparatus with a cutting blade having an edge tapered along a length which corresponds to a depth into which the cigar end is to be cut.

It is still another object of the present invention to provide a cigar cutter which includes an ejector pin disposed in the housing for coaction with a particular one of the cutter tubes to prevent a cigar plug cut from the cigar from being drawn into the apparatus housing when the cutting tube is retracted into the housing.

It is another object of the present invention to provide a cigar cutter having an activator knob accessible at an exterior of the housing with an upper surface terminating in a plane common to the plane of the top of the cutter apparatus housing.

It is another object of the present invention to provide a cutter apparatus with a portion of the housing from which the actuator knob extends having a tapered beveled surface to provide a supportive resting surface for the thumb using the actuator knob.

It is another object of the present invention to provide cutter apparatus including a housing having at least one surface constructed for having indicia or other designs displayed thereon.

It is another object of the present invention to provide a cigar cutter apparatus having relatively few moving parts, which are substantially friction-free without requiring chemical lubricant for many successive cutting operations.

It is another object of the present invention to provide a cigar plug cutting apparatus having a casing constructed with smoothly rounded surfaces to facilitate a comfortable grip in a user's hand for a cigar cutting operating.

BRIEF DESCRIPTION OF THE DRAWINGS

For a more complete understanding of the subject matter of the present invention and the various advantages thereof, reference may be had to the following detailed description taken in conjunction with the accompanying drawings of which.

DETAILED DESCRIPTION OF THE PREFERRED EMBODIMENTS

Figure 1:
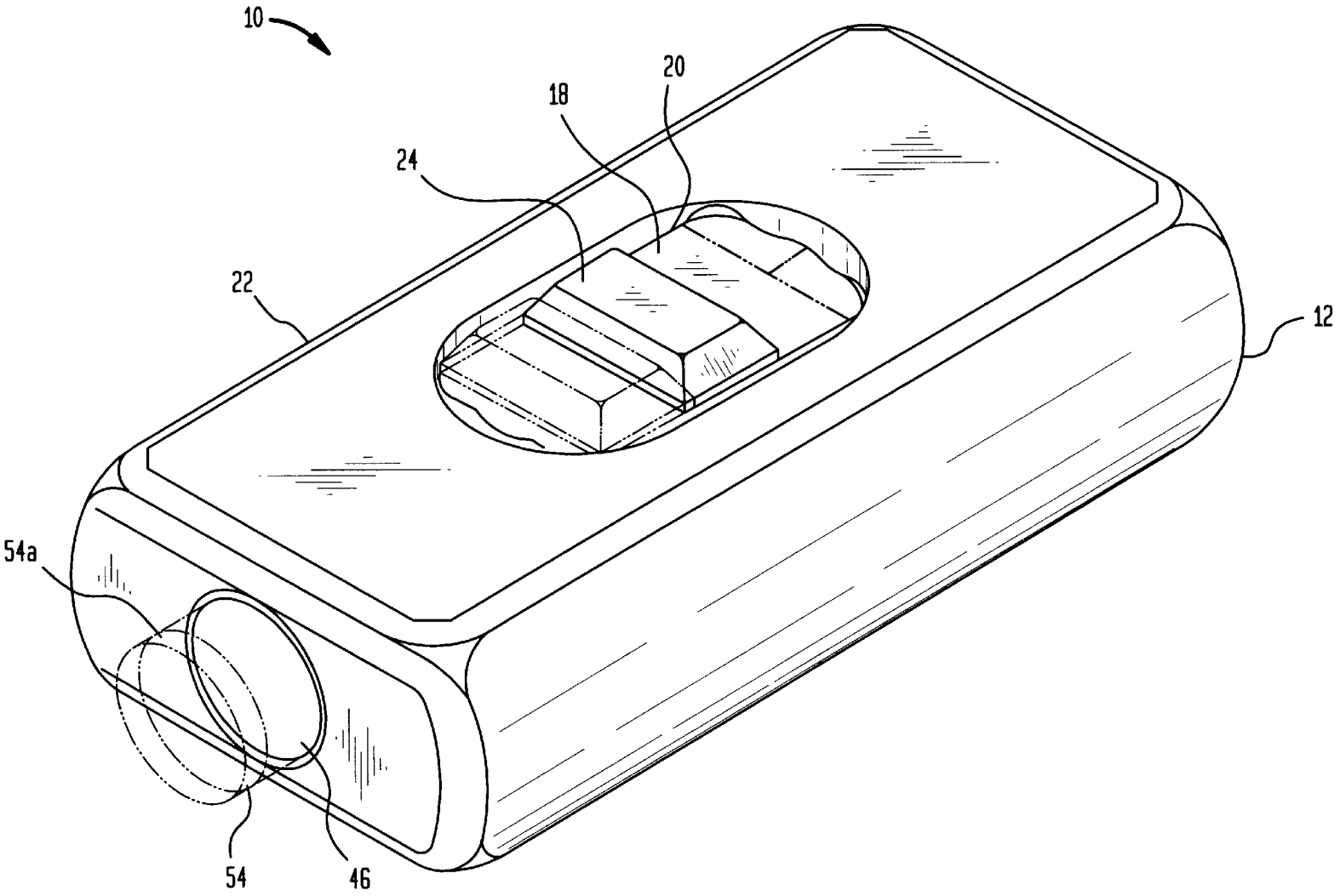
FIG. 1 is a top perspective view of an embodiment of a cigar plug cutter apparatus according to the present invention.
Figure 2:
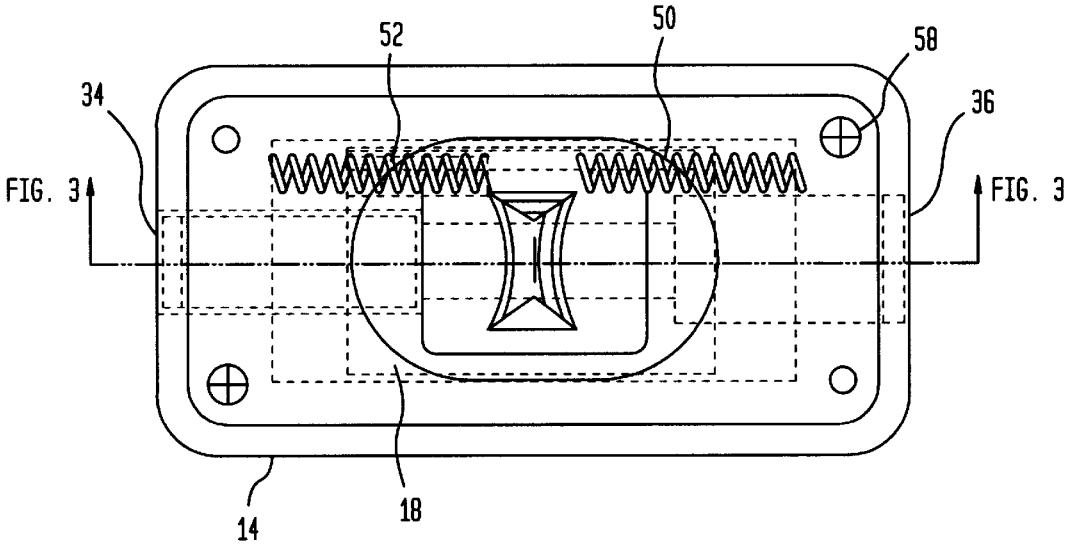
FIG. 2 is a top view of the embodiment of FIG. 1 showing the apparatus in a neutral position.
Figure 3:
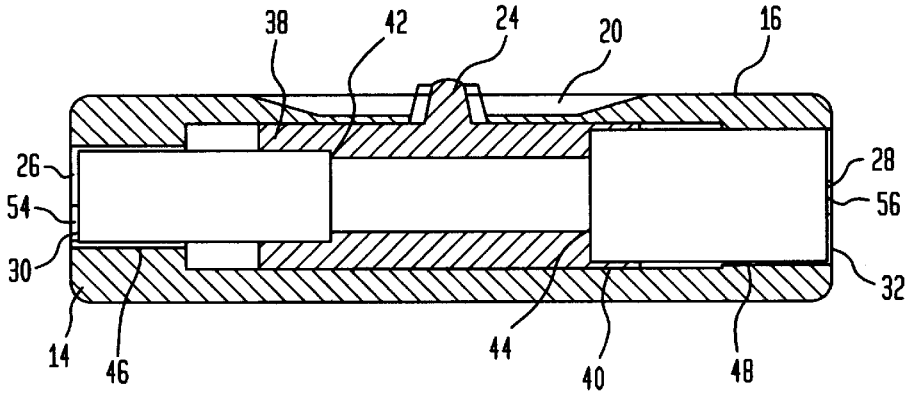
FIG. 3 is a cross-section taken along line 2—2 in FIG. 2.

Referring to FIGS. 1–3, a first embodiment of a cigar plug cutting apparatus of the present invention is shown generally at 10. The apparatus 10 includes a housing 12 having a bottom portion 14, a top portion 16, and a slideable carriage assembly shown generally at 18 which is disposed within the housing 12. When the top and bottom portions are joined, the carriage assembly 18 is encased within the housing 12.

The top portion 16 includes an opening 20 therein along its major exterior surface 22. The opening 20 allows access to the carriage 18 such that the carriage 18 is able to be manipulated from an exterior of the housing 12 for activating the carriage 18 to either side of the housing. A knob 24 integral with the carriage 18 extends from the opening 20 to facilitate manipulation by the user to control the carriage 18.

Each of the top portion 16 and the bottom portion 14 of the housing are provided at their respective opposed sides with trough-like regions. The top portion 16 includes trough regions 26,28 which are in registration with each other at opposed sides of the top portion. The bottom portion 14 of the housing includes trough regions 30,32 which are in registration with each other at opposed sides of the bottom portion. When the top portion 16 and the bottom portion 14 of the housing are joined together, the troughs in the top portion coact with their counter parts in the bottom portion to provide holes 34,36 at opposed sides of the housing. Preferably, a longitudinal axis for the housing 12 extends through a center of the holes 34,36.

As shown in FIG. 3, the carriage 18 is seated in the bottom portion 14 of the housing 12. The bottom portion 14 is provided with sufficient interior space to enable the carriage 18 to be slideable from one end of the housing to the other. Similarly, the top portion 16 is formed with a corresponding interior space to permit the carriage assembly 18 to slide within the top portion as well, when the top and bottom portions are joined together to form the housing. The carriage 18 is constructed and arranged with dimensions sufficient to close-off the opening 20 at the top portion of the housing when the carriage is in the neutral, i.e. not in use, position. This is more clearly shown with respect to FIG. 3.

The carriage 18 includes receiving or mounting ports 38,40 at opposed sides of thereof. As shown in particular with respect to FIG. 3, each one of the mounting ports 38,40 of the carriage 18 are in registration with a corresponding one of the holes 34,36 provided when the top and bottom portions of the housing are joined together.

As is shown in FIG. 3, the mounting ports 38,40 are provided with step portions 42,44 to receive a cutting tube of a particular diameter. For example, the step portion 42 at the bottom of the mounting port 38 will accommodate a cutter 46 having a 6 mm diameter, while the step portion 44 at the bottom of the mounting port 40 will accommodate a cutter 48 having a 8 mm diameter.

As shown in FIG. 2, a pair of springs 50,52 are disposed at opposed sides of the carriage assembly 18 and extend substantially parallel to the movement of the carriage assembly. The springs 50,52 bias the carriage assembly 18 to a neutral, i.e. central, position with respect to the housing when the cutter apparatus is not in use.

The cutters 46,48 resemble tubes, are cylindrical in shape, and are press fit or adhesively secured to the respective mounting ports 38,40 to extend therefrom. The length of the cutting tubes 46,48 is sufficient to extend the tube from the corresponding side of the carriage assembly, but not so long as to have the cutting edges 54,56 of the blade protrude to an exterior of the housing when the carriage assembly 18 is the neutral position. This prevents the sharp edge of the cutting tube from being exposed to the exterior of the housing.

The free or sharpened edges 54,56 of the cutting tubes 46,48 are substantially tapered as more clearly shown with respective to FIG. 1 for a specific reason. That is, when the carriage assembly is moved in a specific direction to deploy a specific one of the cutting tubes 46,48, the tubes will substantially, effortlessly cut into and excise a plug of tobacco from the cigar to a thickness corresponding to the length of the tapered cutting edge. For example, as shown in FIG. 1, when the cutting tube is deployed into an end of the cigar, as soon as the blade has been moved into the cigar end to a depth equal to the length of the cutting edge portion 54*a* of the cutting tube 46, a sufficient amount of tobacco has therefore been cut for removal from the cigar.

Releasing the actuating knob 24 causes the springs 50,52 to bias the carriage assembly 18 in the reverse direction to return the cutting tube 46 into the housing where it is safely retained.

Each one of the top portion 16 and bottom portion 14 may also be provided with a corresponding hole 58 in registration with each other such that a key chain or lanyard (not shown) can be guided through the corresponding holes when the portions are joined to form the housing.

The top portion 16 and bottom portion 14 can be joined together by press fit or welding.

FIGS. 4–7 show another embodiment of the present invention.

Figure 4:
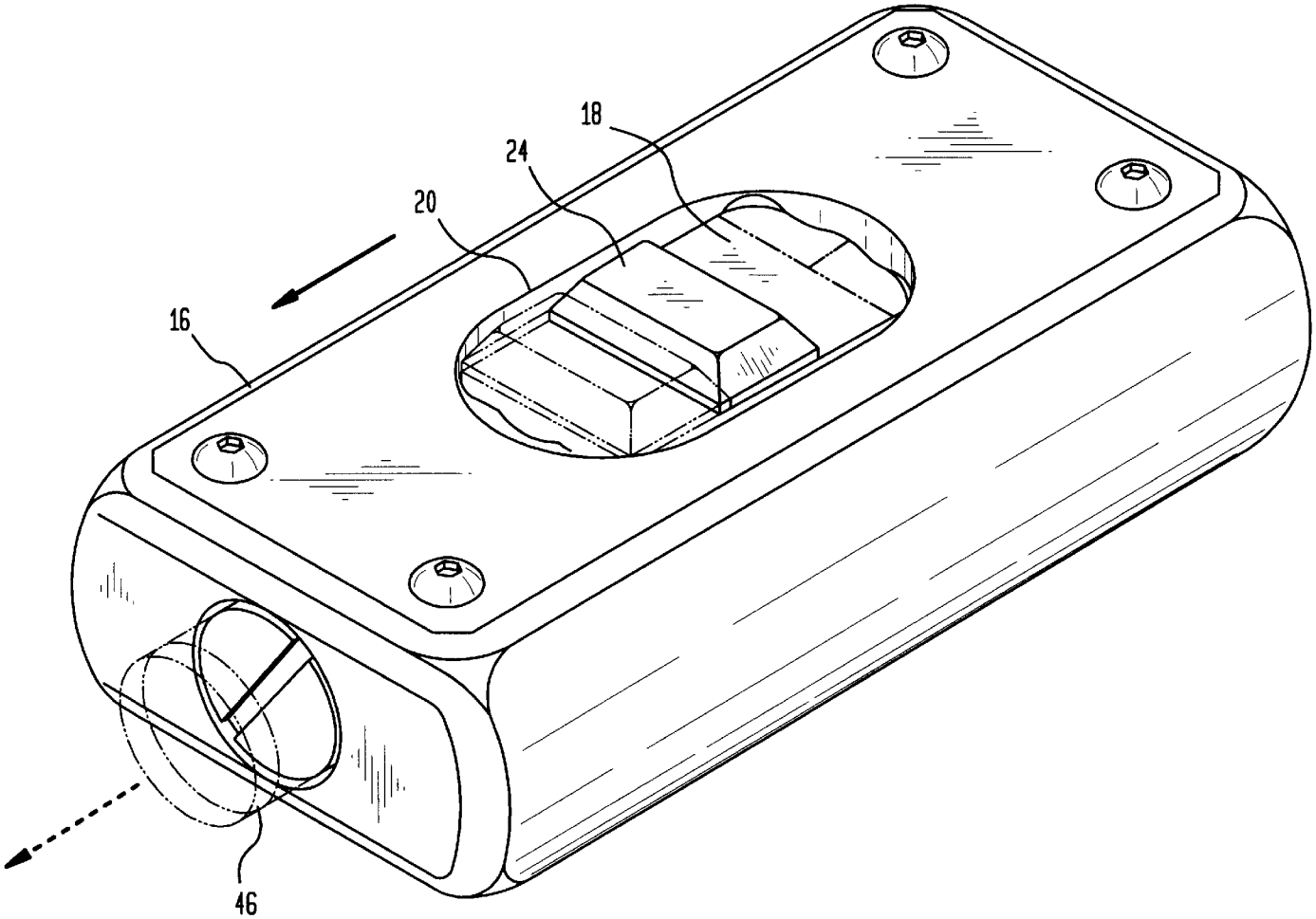
FIG. 4 is a top perspective view of another embodiment of a cigar plug cutter apparatus according to the present invention.

The cigar plug cutter apparatus according to a second embodiment of the present invention is shown generally at in FIG. 4.

Figure 5:
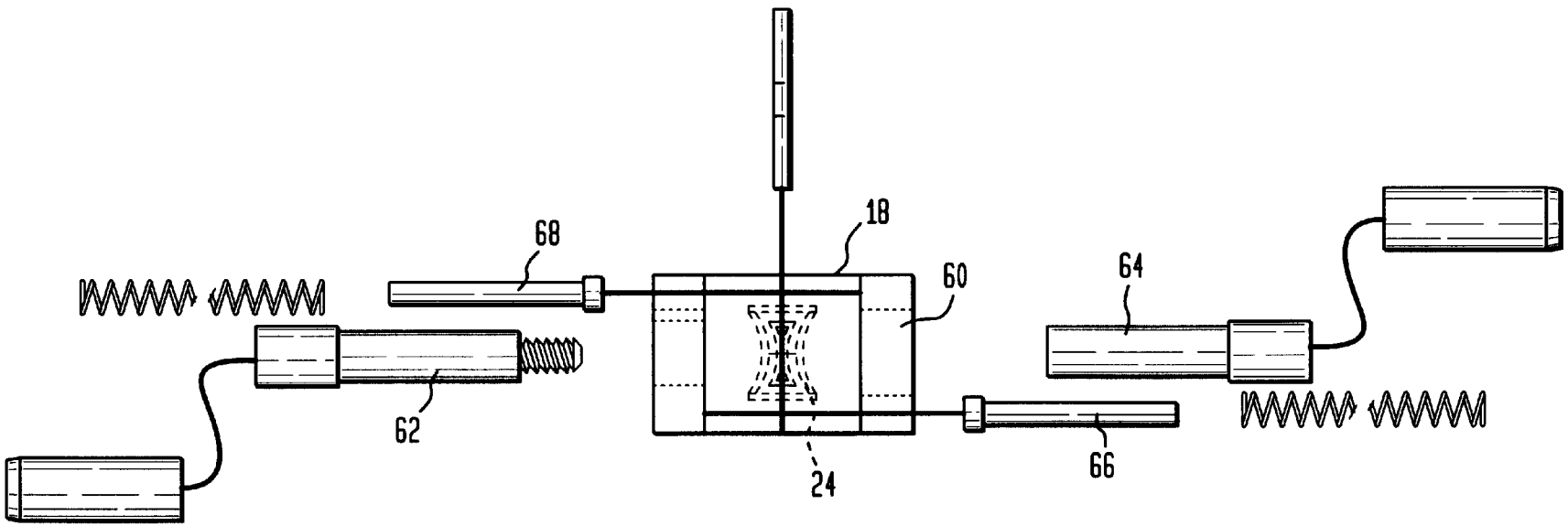
FIG. 5 is an exploded top plan schematic of the embodiment shown in FIG. 4.
Figure 6:
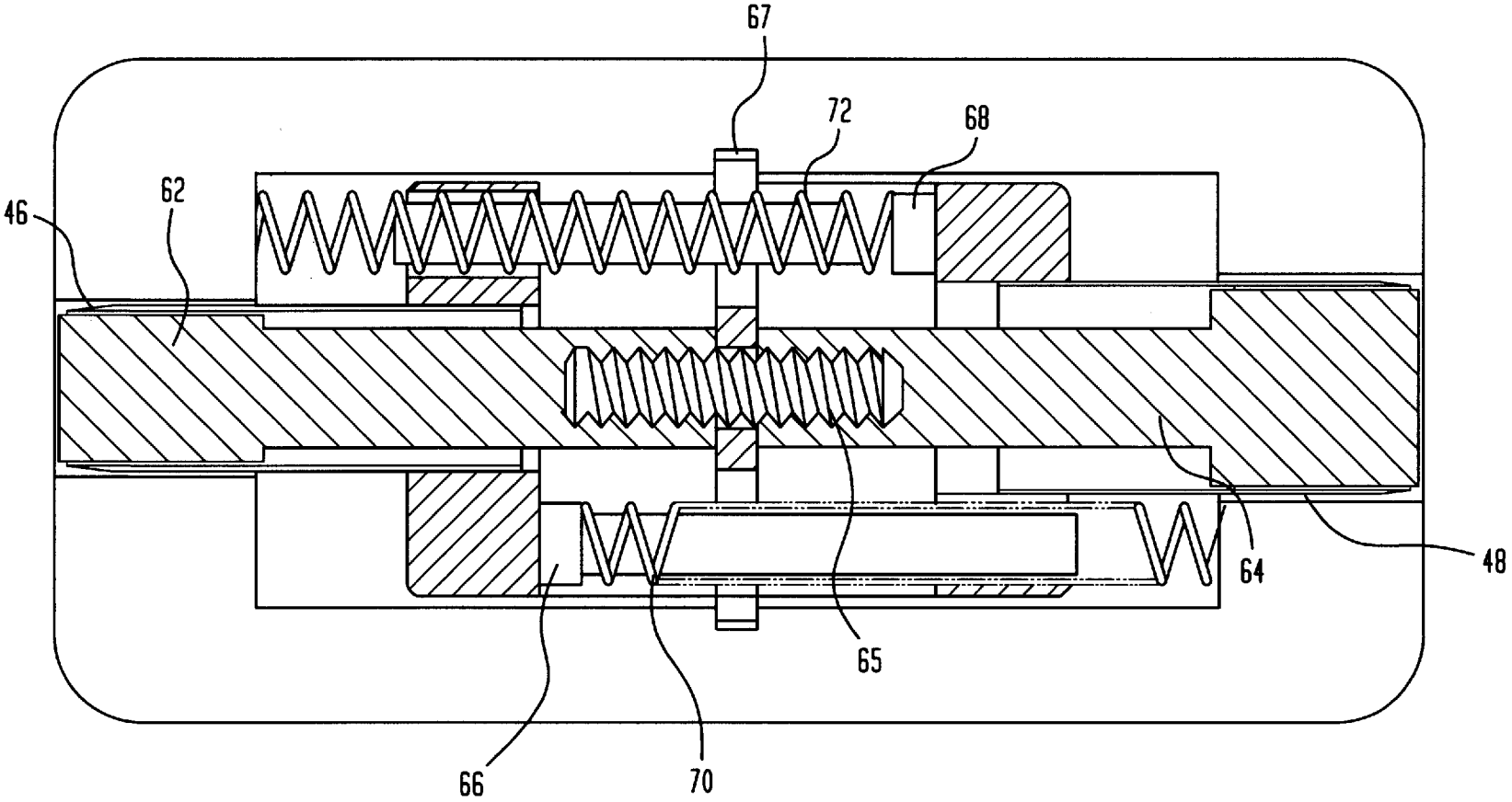
FIG. 6 is a detailed top plan view in cross-section of the embodiment shown in FIG. 4.
Figure 7:
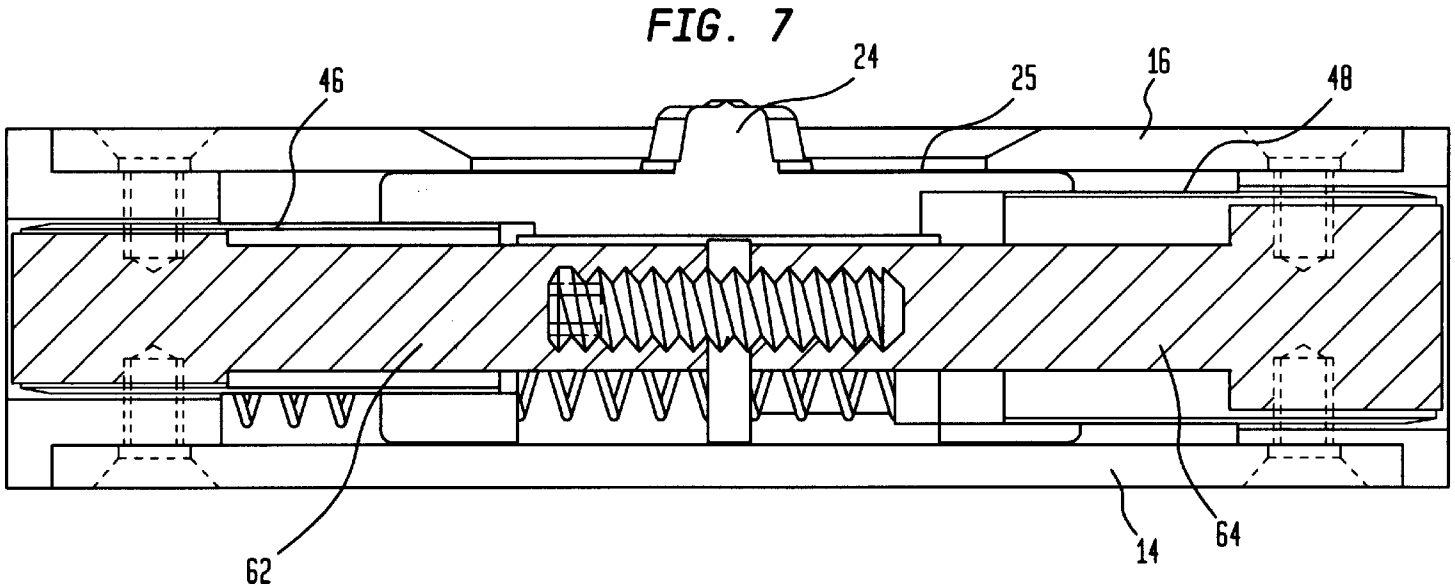
FIG. 7 is a side elevational view in cross section of the embodiment show in FIG. 4.

FIGS. 5–7 show the elements of this embodiment of the present invention which is constructed and arranged with ejector pins which prevent the tobacco plug removed from the cigar from entering the housing of the apparatus.

The embodiments of FIGS. 4–7 are designed for use in a manner similar to that disclosed with respect to the embodiment of FIGS. 1–3, unless otherwise stated.

Generally, as shown in FIG. 4, the actuating knob 24 of the cigar plug cutter apparatus has been deployed in the direction of arrow so that a cutter tube 46 is deployed from a housing for this embodiment.

More particularly, referring also to FIGS. 5–7, a housing for this embodiment includes a top portion 16 and a bottom portion 14 which are joined together with mechanical fasteners, such as hex screws. Each one of the top portion and the bottom portion include an interior space for holding elements which will be described hereinafter for slideable movement of a carriage assembly for this embodiment.

As shown in FIG. 5, the carriage assembly 18 has a central bore 60 formed therethrough at the center of which are threadably connected a pair of ejector pins 62,64 to extend to corresponding sides of the housing from the carriage assembly. The actuating knob 24 extends from a top of the carriage assembly to be accessible at the top of the housing similar to that discussed with respect to FIG. 1. Each one of the ejector pins remains stationary in the housing and of a length such that the ejector pin does not extend beyond an opening in the housing for the respective ejector pin as shown, for example, in FIG. 6. A pair of guide pins 66,68 extend from the carriage assembly at diagonally opposed sides of the assembly. Springs 70,72 are mounted to a corresponding one of the guide pins.

A tubular cutter is mounted to a slide for the carriage assembly. The tubular cutters 46,48 can be of different diameters, as shown in FIG. 6, but have dimensions and a tapered cutting blade edge similar to that with respect to FIGS. 13–3

As shown in FIG. 7, an actuating knob 24 for the slide 25 extends from an opening in a top portion of the housing. In this embodiment, by way of example, the actuating knob extends above a top surface of the top of the housing, but will be understood that the knob can also be manufactured to terminate at an upper surface coplanar with the exterior surface of the housing, as shown in FIG. 1.

A retaining means in the form of a longitudinal member or a plate 16 is disposed to extend transverse to the open region of the bottom portion of the housing. Opposed sides of the housing are formed with detents so that the retaining means is fixedly seated transverse to the ejector pin assembly and cutter tubes. As shown in FIGS. 6 and 7, a central aperture in the retainer means is provided at which point the complementary threaded portions of the ejector pins 62,64 are engaged to extend to their respectively opposed sides of the housing. A locking screw 65 holds the ejector pins together and a mounting plate 67 holds the pins at the center of the housing. Similarly, another pair of apertures are formed at opposed sides of the retainer plate through which one of the guide pin, spring combination extends.

As shown in FIG. 6, movement of the slide in a direction along arrow causes the spring 72 to compress and the spring 70 to expand for deploying the cutter. Releasing the actuator knob of the slide, will cause each one the springs to return bias to their original neutral position thereby retracting the cutter into the housing. A similar coaction of the elements occurs when the slide is moved in the direction of arrow to deploy the cutter tube from the housing.

Safety locking features can be employed in connection with the construction of the Cigar Plug Cutter to prevent unintended movement of the cutting members that would extend beyond the housing. The cutters may be recessed at each end when in the neutral central position to prevent such unintended movement.

Figure 8:
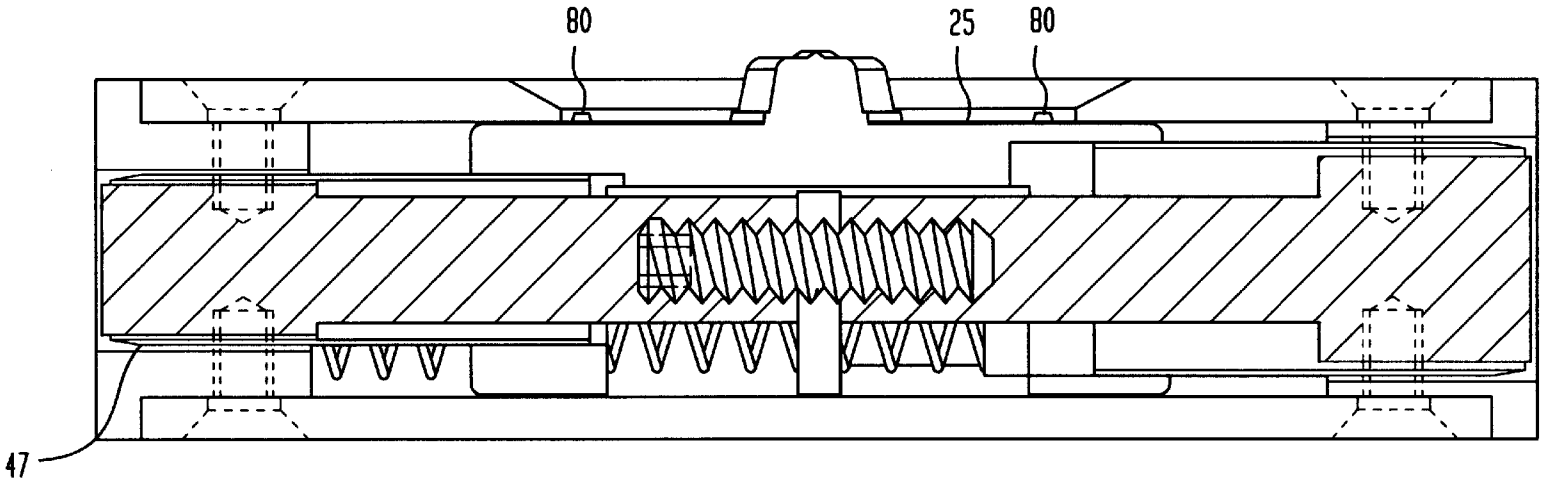
FIG. 8 is a side cross-sectional view of FIG. 4 showing a locking mechanism to prevent unintended movement of the cutting edge.

One example is shown in FIG. 8 where detents 80 can be formed on the slide 25 which would coact with the end of the top cover plate so that when the slide 25 is in the neutral position, the detents 80 would be outside the cover plate and a slight deformation of the cover plate and/or of the slide 25 could be formed in order to get the slide 25 underneath the cover plate to extend the knife edge of the cutter beyond the end of the housing. Note that in this embodiment the end 47 of the cutters 46 are substantially shorter than the end of the housing in order to provide a space as a safety measure to prevent the cutters 46 from unintentionally or inadvertently extending beyond the housing.

Figure 9:
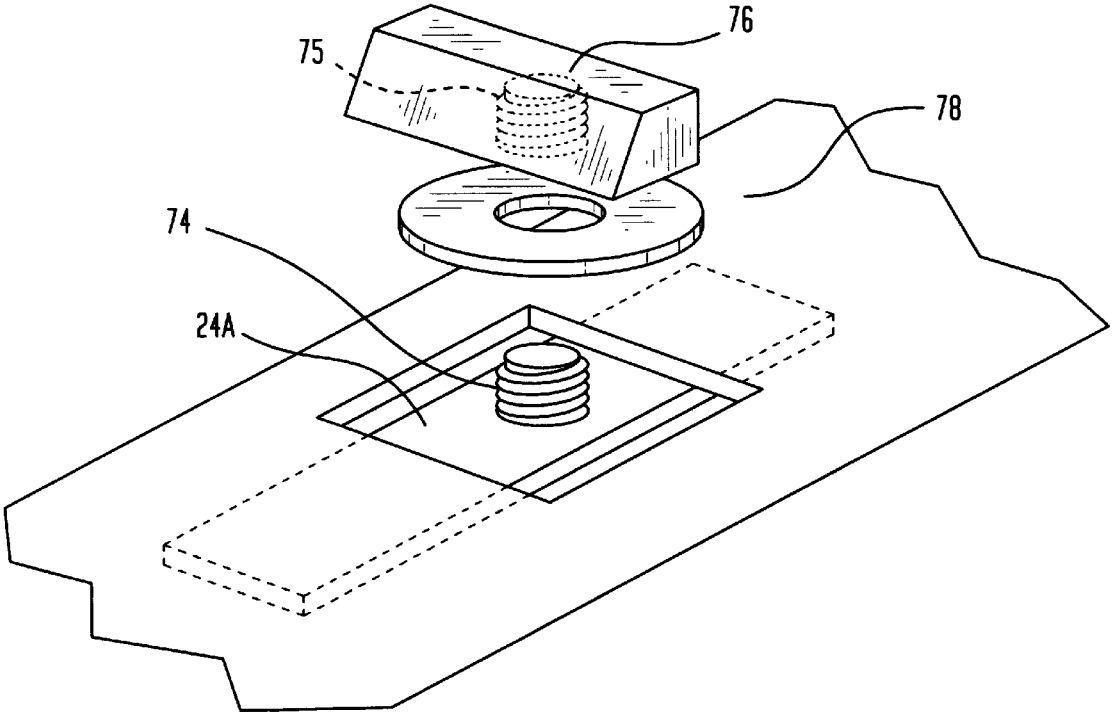
FIG. 9 is a top perspective view of another locking mechanism.

In FIG. 9 another embodiment has the slide 24A formed in three pieces. A screw 74 extends upward from the base of the slide 24A and connects an engaging portion 76 having a threaded hole 75 which is adapted to threadably engage the screw 74 extending upward. A washer 78 is disposed between the engaging member 76 and the screw 74 so that rotation of the engaging member 76 will compress the washer 78 against the top cover plate and prevent movement of the slide 24 and consequently the cutter 46.

Only a relatively small movement of the engaging member 76, for example, 90°, would be necessary to loosen the washer 78 or relieve the pressure on the washer 78 sufficient to allow for easy movement of the cutter 46.

Figure 10:
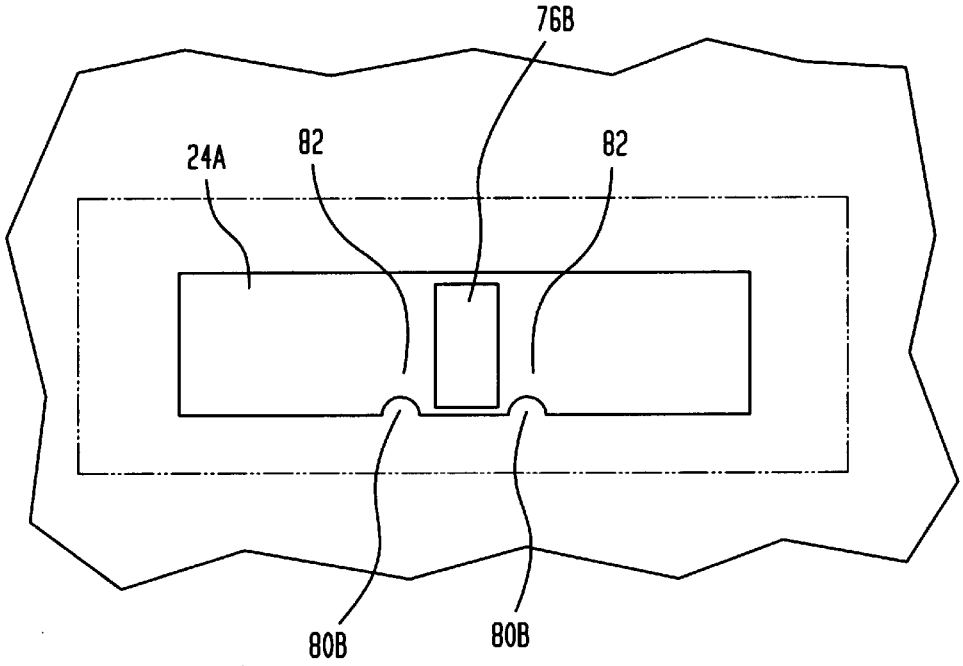
FIG. 10 is a top view of a further locking mechanism.

FIG. 10 shows another embodiment where detents 82 are formed on the side of the slide 24A to cooperate with protrusions 80B at the border or side of the opening. 76B designates an actuating knob. Coaction between recessed cutters 46 as shown in FIG. 8 and the position of the detents 82 ensure that the edges of the cutters 46 do not protrude at the position with the slide 24A being displaced from the neutral position being urged against a detent 82 by urging of a spring.

It will be understood that the embodiments described herein are merely exemplary and that a person skilled in the art may make variations and modifications to the present invention without departing from the spirit and scope of the invention. All such modifications and variations are intended to be included within the scope of the invention as defined by the claims herein.

What is claimed is:

1. A cigar plug cutter, comprising:

a housing having a longitudinal passage with apertures at each end, a pair of hollow tubular cutters disposed at respective ends of said passage, an opening in a wall of said housing, an actuating member secured to said cutters for moving said cutters within said passage and out of said apertures, said cutters being engageable with the ends of cigars for cutting cylindrical plugs therein, a projection on said actuating member extending through and movable within said opening for moving said actuating member, a pair of springs biasing said cutters and actuating member to be positioned in the center of said passage and being movable upon movement of said projection and actuating member, movement of said projection and actuating member in one direction causing one of said cutters to extend out of one aperture and movement of said projection and actuating member in the other direction causing the other of said cutters to extend from the other aperture, and said pair of springs causing said cutters and actuating member to return within said passage upon release of said projection.

2. The device of claim 1 including a pair of ejector pins positioned concentrically within respective cutters at each end, means for securing said ejector pins together within said passage, a mounting plate for holding said ejector pins fixed within said housing so that relative movement of said cutters from an extended to a central position will cause ejection of any cigar plug cut from a cigar.

3. The device of claim 2 including a pair of guide pins positioned within said housing adjacent to respective ejector pins, said pair of springs being disposed about respective guide pins for biasing movement of said cutters, movement of one cutter causing compression of one spring in one direction and expansion of the other spring so that said one cutter is returned to a central position upon cessation of movement.

4. The device of claim 3 wherein said actuating member is manually moveable and is secured to each cutter for movement in either direction to move said cutters along and over said fixed ejector pins.

5. The device of claim 4 wherein said cutters and apertures at each end are of different diameter sizes to cut different sized cigars.

6. The device of claim 5 wherein said cutters are recessed with respect to the ends of said apertures in said housing.

7. The device of claim 5 including locking means for preventing unintended movement of said cutters out of the ends of said apertures.

8. The device of claim 7 wherein said locking means includes coacting detents and protrusions on the periphery of said opening in said wall of said housing and an edge of said actuating member.

9. The device of claim 5 including a threaded extension on said actuating member, a mating threaded member mountable on said extension and a washer secured between said members, said washer and mating member preventing movement of said cutters when tightly engaged and permitting movement when released.

10. A cigar plug cutter, comprising:

a housing having a longitudinal passage with apertures at each end;

a pair of cylindrical cutters disposed at respective ends of said passage;

an opening in a wall of said housing;

an actuating member secured to said cutters for moving said cutters within said passage and out of said apertures;

a projection on said actuating member, said projection extending through and movable within said opening for moving said actuating member;

a pair of springs biasing said cutters and actuating member to be positioned in the center of said passage;

movement of said projection and actuating member in one direction causing one of said cutters to extend out of one aperture and movement of said projection and actuating member in the other direction causing the other of said cutters to extend from the other aperture;

said pair of springs causing said cutters and actuating member to return within said passage upon release of said projection;

a pair of ejector pins positioned concentrically within respective cutters at each end;

means for securing said ejector pins together within said passage;

a mounting plate for holding said ejector pins fixed within said housing so that relative movement of said cutters from an extended to a central position will cause ejection of any cigar plug cut from a cigar; and a pair of guide pins positioned within said housing adjacent to respective ejector pins;

said pair of springs being disposed about respective guide pins for biasing movement of said cutters so that movement of one cutter causes compression of one spring in one direction, said one cutter being returned to a central position upon cessation of movement;

said actuating member being manually moveable and being secured to each said cutter for movement in either direction to move said cutters along and over said fixed ejector pins;

said cutters and apertures at each end being of different diameter sizes to cut different sized cigars;

said cutters being recessed with respect to the ends of said apertures.

11. The device of claim 10 including:

locking means for preventing unintended movement of said cutters out of said ends of said apertures;

said locking means including coacting detents and protrusions on the periphery of said opening in said wall of said housing and an edge of said actuating member.

* * * * *